US009928818B2

(12) United States Patent
Patrick

(10) Patent No.: US 9,928,818 B2
(45) Date of Patent: Mar. 27, 2018

(54) PIEZOELECTRIC PICKUP AND CELL FOR STRINGED INSTRUMENTS

(71) Applicant: Joseph W. Patrick, Marquette, MI (US)

(72) Inventor: Joseph W. Patrick, Marquette, MI (US)

( * ) Notice: Subject to any disclaimer, the term of this patent is extended or adjusted under 35 U.S.C. 154(b) by 0 days.

(21) Appl. No.: 15/343,354

(22) Filed: Nov. 4, 2016

(65) Prior Publication Data

US 2017/0076706 A1 Mar. 16, 2017

Related U.S. Application Data

(62) Division of application No. 14/559,789, filed on Dec. 3, 2014, now Pat. No. 9,495,948.

(60) Provisional application No. 61/911,207, filed on Dec. 3, 2013.

(51) Int. Cl.

| | |
|---|---|
| ***G10D 3/04*** | (2006.01) |
| ***G10H 3/14*** | (2006.01) |
| ***G10H 3/18*** | (2006.01) |

(52) U.S. Cl.

CPC ..... *G10H 3/143* (2013.01); *G10H 3/181* (2013.01); *G10H 3/185* (2013.01); *G10H 2220/471* (2013.01); *G10H 2220/475* (2013.01); *G10H 2220/525* (2013.01)

(58) Field of Classification Search

CPC .... G10D 3/04; G10H 3/185; G10H 2220/525; G10H 3/181; G10H 2220/495

See application file for complete search history.

(56) References Cited

U.S. PATENT DOCUMENTS

| | | | | |
|---|---|---|---|---|
| 4,147,084 A * | 4/1979 | Underwood | G10H 3/185 | 84/731 |
| 4,356,754 A * | 11/1982 | Fishman | G10H 3/185 | 84/731 |
| 4,635,523 A * | 1/1987 | Merchant | G10D 3/04 | 84/307 |
| 4,785,704 A * | 11/1988 | Fishman | G10H 3/185 | 84/731 |
| 4,951,541 A * | 8/1990 | McMillan | G10D 3/18 | 84/280 |
| 6,336,367 B1 * | 1/2002 | Raisanen | G10H 3/185 | 73/632 |
| 7,319,188 B1 * | 1/2008 | Birkhamshaw | G10H 3/185 | 84/731 |

(Continued)

*Primary Examiner* — Marlon Fletcher

(74) *Attorney, Agent, or Firm* — The Weintraub Group, P.L.C.

(57) ABSTRACT

In a first aspect hereof the present invention provides an improved piezoelectric pickup which, generally, comprises a folded planar plastic piezoelectric sandwich electrically connected to a coaxial cable which, in turn, is in electrical communication with a jack or the like for connection to a pre-amp, an amplifier or the like. In a further aspect of the present invention there is provided a "cell" which is particularly adapted for use with an electric violin. The "cell" comprises a table which is disposed substantially parallel to the top of the instrument and substantially normal or perpendicular to and in contact with the bridge of the instrument. When used in conjunction with a pickup the cell facilitates simulation of the sound of an acoustic violin.

15 Claims, 7 Drawing Sheets

(56) References Cited

U.S. PATENT DOCUMENTS

| | | | | |
|---|---|---|---|---|
| 2004/0099123 | A1* | 5/2004 | Van Dusen | G10D 3/04 84/307 |
| 2005/0011342 | A1* | 1/2005 | Fishman | G10H 3/143 84/730 |
| 2005/0028669 | A1* | 2/2005 | Kavanaugh | G10H 3/181 84/726 |
| 2008/0190260 | A1* | 8/2008 | Lye | G10D 3/00 84/173 |
| 2011/0162506 | A1* | 7/2011 | Yokoyama | G10D 1/00 84/294 |
| 2012/0085217 | A1* | 4/2012 | Threlkeld-Wiegand | G10D 1/02 84/276 |
| 2012/0090449 | A1* | 4/2012 | Lee | G10H 3/143 84/731 |
| 2013/0139669 | A1* | 6/2013 | Siwko | G10D 1/02 84/277 |
| 2015/0228263 | A1* | 8/2015 | Patrick | G10H 3/181 84/731 |

* cited by examiner

PIEZOELECTRIC PICKUP AND CELL FOR STRINGED INSTRUMENTS

CROSS-REFERENCE TO RELATED APPLICATIONS

This application is a divisional application of copending U.S. patent application Ser. No. 14/559,789, filed Dec. 3, 2014, which is a completion application, and claims the priority benefit of U.S. Provisional Patent Application No. 61/911,207, filed Dec. 3, 2013 for "IMPROVED PIEZOELECTRIC PICKUP AND CELL FOR STRINGED INSTRUMENTS", the disclosures of which are hereby incorporated by reference including the drawings.

BACKGROUND OF THE INVENTION

1. Field of the Invention

The present invention pertains to stringed instruments. More particularly, the present invention pertains to enhancement for bridged string instruments. Even more particularly, the present invention concerns sound enhancement devices for electric and acoustic violin-type bridged stringed instruments.

2. Prior Art

As is known to those skilled in the art to which the present invention pertains, amplified violin-type electric and acoustic instruments are, essentially, instruments with four or more strings which are played with a bow and are equipped with an electronic output for transmitting their sound. Ordinarily, an electric violin has a solid body which uses a pickup. Pickups are well-known and are provided in one or more configurations.

Among the several configurations there are, for example, integral bridge/pickup designs, pickups that are fitted or glued to a conventional wood bridge and the like.

Piezoelectric pickups for use with electric violins and other electric bowed-stringed instruments are another type of pickup which have long been known. Ordinarily, these pickups are "flat" devices which are either laid in directly into the bridge of the instrument or are fitted into the wing slots of the bridge.

Amplified acoustic violins, on the other hand, typically use an add-on piezoelectric pickup which is disposed either on the bridge or on the body of the instrument.

Although other types of pickups are known, piezoelectric pickups are the most used with both electric and acoustic violins since they are inexpensive and more common. These piezoelectric pickups have different geometric shapes such as discs, cylinders or rectangular and ordinarily comprises flat members. These pickups detect physical or mechanical vibrations either directly from the instrument, but usually from the bridge vibrations which are actually sensed. The pickups convert the mechanical vibrations to electric signals.

Piezoelectric pickups have a high output impedance and are typically plugged into a high impedance input stage in an amplifier or a powered preamp via a jack or the like. The powered input stage buffers the signal by impedance matching, to avoid low frequency loss and microphonic noise pickup in the instrument cable, which is common practice with piezoelectric pickups.

When fitted to a wing slot, present day pickups only contact either the upper wall or the lower wall of the slot, but not both.

As will be discussed hereinafter the present invention overcomes this deficiency through an improved pickup.

Also, as is known to the skilled artisan, the duplication of sound generated by an electric violin or other bowed instrument to accurately simulate that of an acoustic violin is an area that heretofore has not been adequately addressed. Thus, and in another aspect of the present invention, a "cell" disposed on the body of an electric violin in proximity to and in contact with the bridge overcomes this deficiency.

When combining the ability of duplication created by the cell along with the present improved piezoelectric pickup, enhanced sound from an electric violin is rapidly achieved. It is to this to which the present invention is directed.

SUMMARY OF THE INVENTION

In a first aspect hereof the present invention provides an improved piezoelectric pickup which, generally, comprises a folded planar plastic piezoelectric sandwich electrically connected to a coaxial cable which, in turn, is in electrical communication with a jack or the like for connection to a pre-amp, an amplifier or the like.

The piezoelectric pickup hereof, in use, is fitted or installed in a slot of a bridge of an electric violin or other stringed instrument.

Due to its construction, the pickup engages or contacts both walls of the associated slot. The pickup can be used with either an electric violin or an acoustic violin or on any stringed instrument having a bridge with a slot between separate upper and lower vibrating members including any other bowed-stringed instrument such as a cello, viola or the like. The pickup can also be used with other stringed instruments having a bridge with a slot between separate upper and lower vibrating members or laterally spaced vibrating members including a mandolin, arch top guitar and the like.

In a further aspect of the present invention there is provided a "cell" which is particularly adapted for use with an electric violin. The "cell" comprises a table which is disposed substantially parallel to the top of the instrument and substantially normal or perpendicular to and in contact with the bridge of the instrument. When used in conjunction with a pickup, the cell facilitates simulation of the sound of an acoustic violin.

For a more complete understanding of the present invention, reference is made to the following detailed description and accompanying drawing.

In the drawing like reference characters refer to like parts throughout the several views in which:

DESCRIPTION OF THE INVENTION

It should be noted that throughout the ensuing description reference may be made to a violin. However, it is to be understood that the present invention is applicable to other bowed string instruments, i.e., stringed instruments typically played with a bow, such as the viola, cello, bass, and the like. The present pickup may also be used with a mandolin, arch top guitar and the like. It is also possible to adapt the present pickup to other guitars and other stringed instruments having a wing slot bridge. However, for purposes of the present description reference will be made to a violin.

Figure 2:
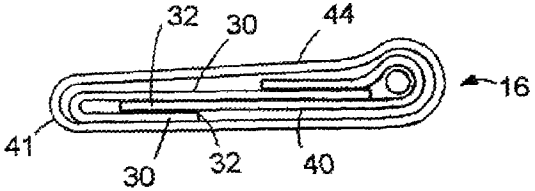
FIG. 2 is a side view of the pickup hereof.
Figure 1:
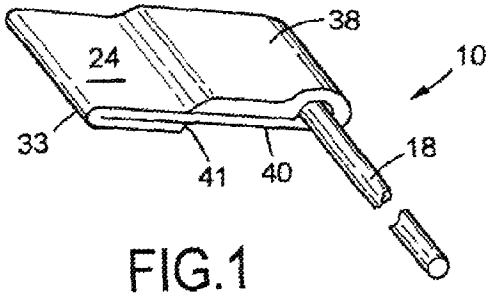
FIG. 1 is a perspective view of a first embodiment of a piezoelectric pickup in accordance with the present invention.
Figure 1B:
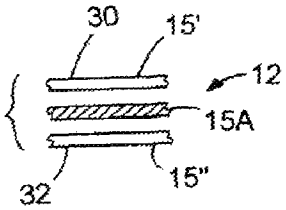
FIG. 1B is an exploded cross-sectional view taken along line 1B-1B of FIG. 1A.
Figure 3:
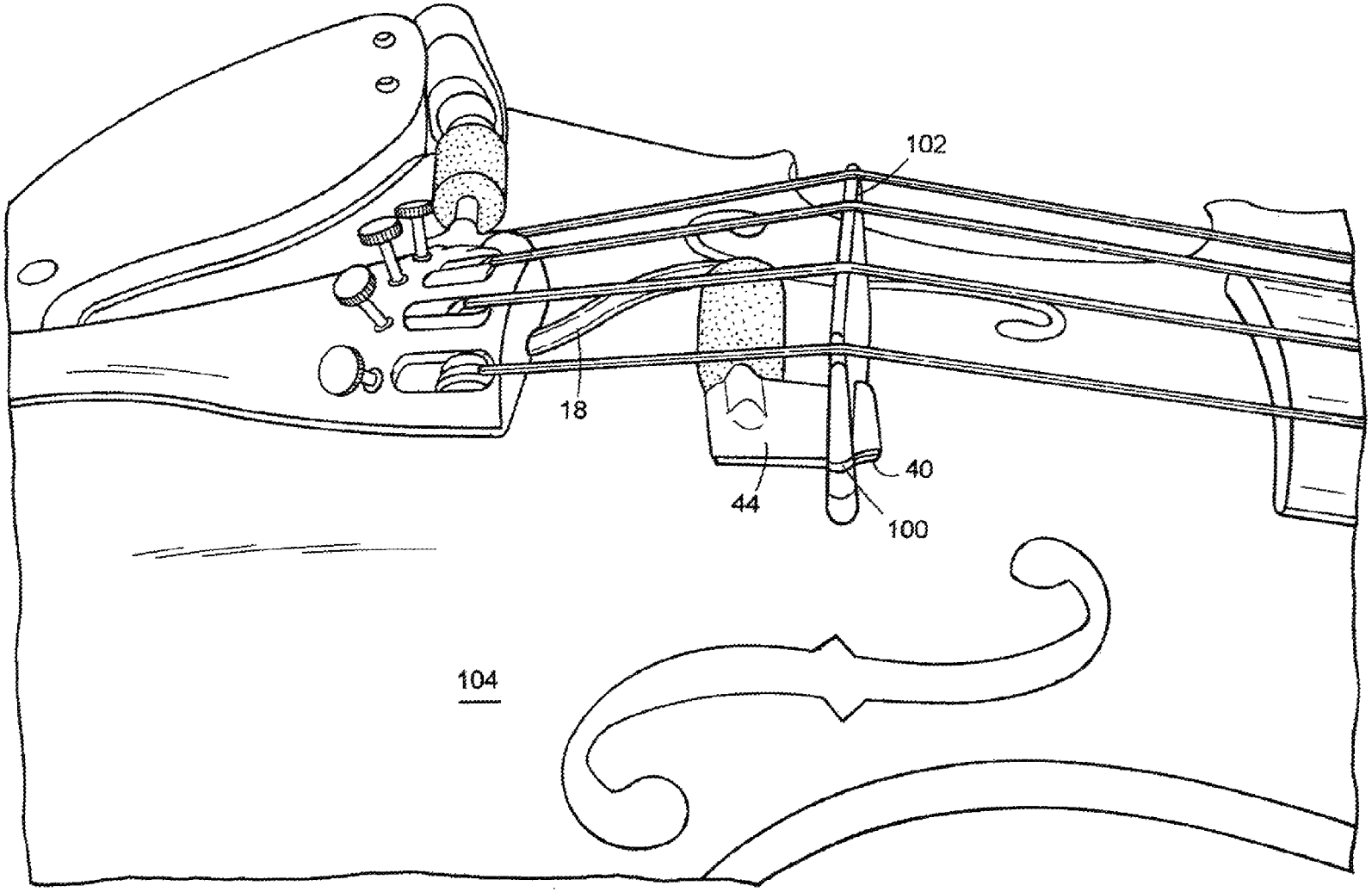
FIG. 3 is a perspective view of the pickup hereof installed in a wing slot of a violin.
Figure 4A:
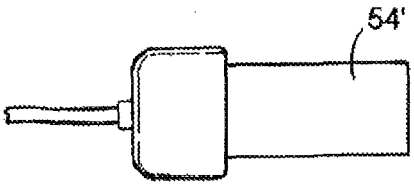
FIG. 4A is a top view hereof.
Figure 4B:
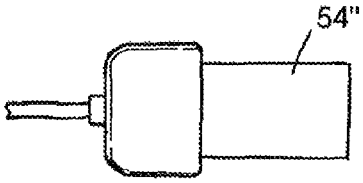
FIG. 4B is a bottom view thereof.

Now, with reference to the drawing, and in particular, FIGS. 1-3, and in accordance with the present invention and in a first aspect hereof, there is provided a first embodiment of a piezoelectric pickup, generally, denoted at 10, including a piezoelectric element 12.

The piezoelectric element 12, generally, comprises a flexible sandwich 15 of a piezoelectric material 15A disposed between a pair of conductive films 15', 15". One film is connected to a shield and the other to a center conductor via leads or conductors 16, 16'. The conductors 16, 16' are connected to the element 12 at a first end 17 of the piezoelectric element 12 thereof, opposite a second end 17'. The films 15', 15" are shielded with conventional shielding laminate or foil. It is to be understood that the actual construction of the films 15', 15" is not critical hereto, only their flexibility and their ability to be folded over themselves is critical. These films 15', 15" are well known and commercially available, such as that sold under the mark "MEAS".

In use, the conductors 16, 16' are electrically connected to a coaxial cable 18 by splicing or the like. The cable 18 ordinarily connects to either a jack (not shown) for connection to a pre-amp or to an amplifier (not shown).

As shown in the drawing, the piezoelectric element 12 has an upper surface 30 defined by film 15' and a lower surface 32 defined by film 15". The element 12, itself, is sufficiently flexible to be folded back upon itself such that the upper surface 30 when folded back upon itself is always the exposed surface.

In manufacturing the present pickup 10, the element 12 is folded over about a fold line 33. The fold line 33 is determined by dividing the active area of the film 15" in half and folding the element 12 back upon itself.

Once folded, the pickup 10 has a first section or tongue 24 and a second section 38 with a space or gap 41 provided therebetween.

A compressible and expandable tape 40 is disposed in the gap 41 and is sandwiched between the folded over sheet.

The tape 40 is, preferably, a double-stick foam tape.

The tape 40 is used to hold the upper portion and lower portion of the element 12 together. The tape 40 holds the folded element 12 together and, most critically, concurrently exerts sufficient pressure against the upper and lower sections of the element 12, to urge the element 12 in its folded condition, into contact with both the upper and lower wall of a wing slot 100 of a bridge 102 of a violin 104 for a proper compressive fit when installed in the wing slot 100.

The pickup 10 further includes a covering of electrical tape 44. Electrical tape 44 is adhered to the element 12 from the fold line 32, past the conductors 16, 16', and over onto the top of the element 12, while encasing the conductors 16, 16' themselves and that portion of the coaxial cable 18 to which they are connected or spliced.

The electrical tape 44 is wrapped over the foam tape 40 and enshrouds the entire element 12.

In use, the coaxial cable 18 has spaced foam dampers 26 disposed along the length thereof to dampen any vibrations and to avoid direct contact between the cable 18 and the tailpiece of the instrument.

As noted hereinabove the coaxial cable 18 terminates at a jack or a pre-amp in a well-known manner.

In manufacturing the pickup 10, the films 15', 15" are first trimmed and the active area defined by the remainder, which is divided in half to determine the fold line 33.

The double stick foam tape 40 is applied to the bottom surface from the fold line 33 to beyond the terminal connection.

The film is then folded over and pinched to adhere together the folded plastic material and the tape 40. The tape 40 is adhered to the exposed upper surface, as well. The electrical tape 44 is then used to wrap and enshroud the foam tape and the piezoelectric element 12.

As shown in and referring to FIGS. 3 and 6-8, once assembled, the pickup 10 is inserted into the wing slot 100 of the violin bridge 102.

Figure 1A:
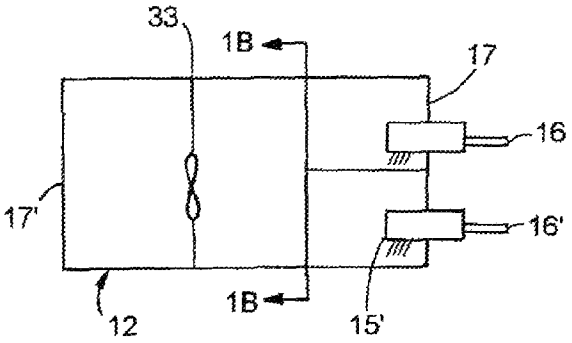
FIG. 1A is a plan view of an unfolded piezoelectric element.
Figure 6:
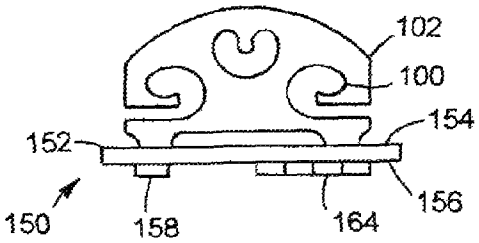
FIG. 6 is a side view of a bridge and a first embodiment of a cell in accordance herewith.
Figure 4:
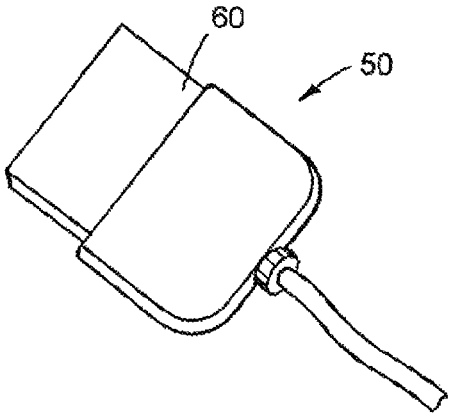
FIG. 4 is a perspective view of a second embodiment of a piezoelectric pickup in accordance herewith.
Figure 7:
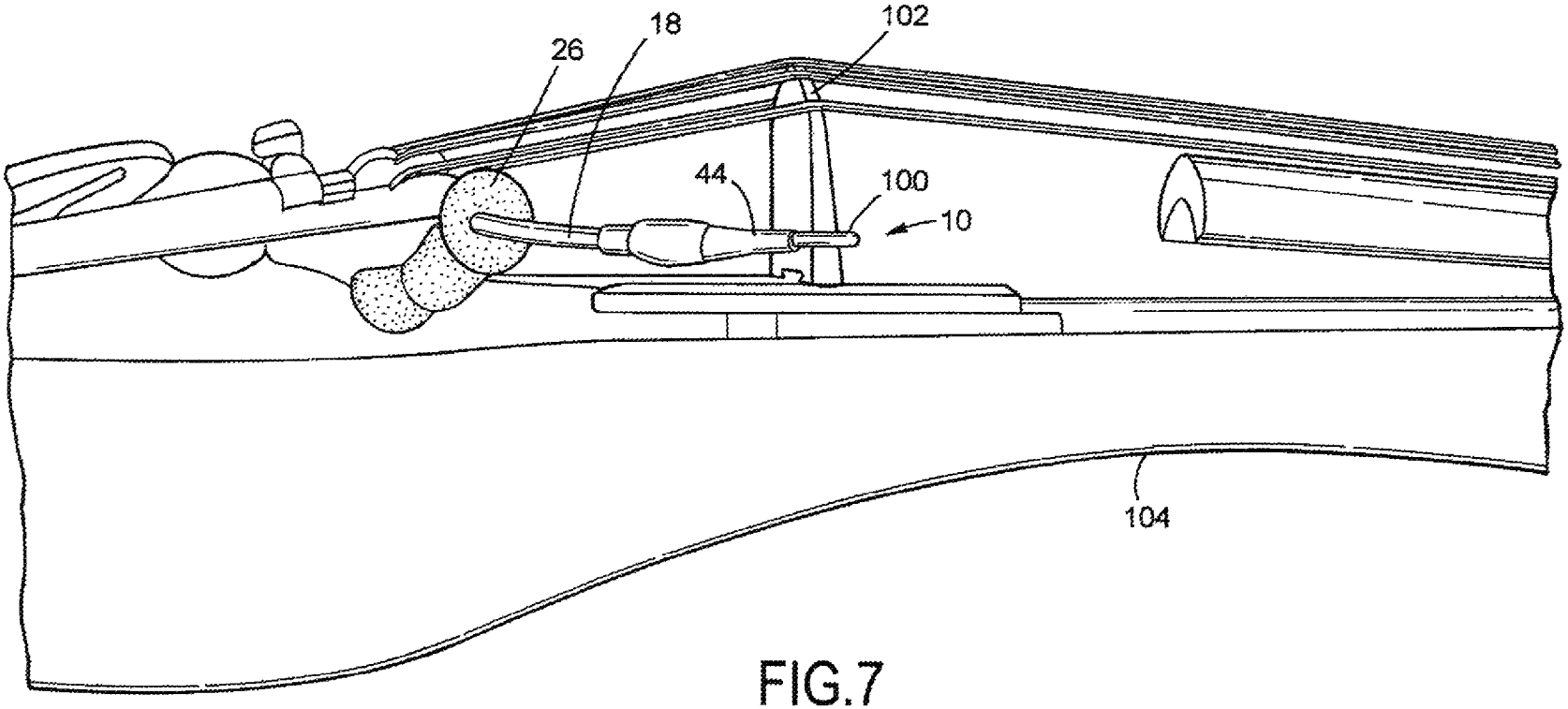
FIG. 7 is a side view of a solid body electric violin having the cell and the pickup of FIG. 6 in the wing slot of the bridge.

Referring now to FIGS. 4-6, there is depicted therein a further or second embodiment of a pickup in accordance herewith.

The pickup of this embodiment, generally, denoted at 50 is substantially of the same structure as the first embodiment and includes a sandwich 52 of a piezoelectric material 53 disposed between conductive films 54', 54", defining top and bottom surfaces, respectively.

According to this embodiment, the sandwich 52 is divided into three segments, 56, 56', and 56". As shown, a double-foam stick tape 58 is adhered to the top surface 54' of the outer most section 56".

Figure 5A:
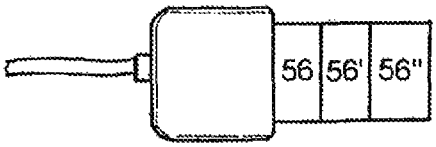
FIG. 5A-D shows progression in assembling the second embodiment thereof.
Figure 5B:
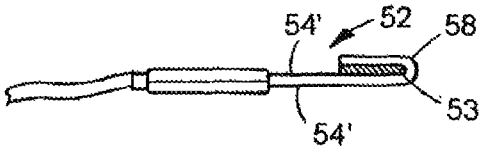
Figure 5C:
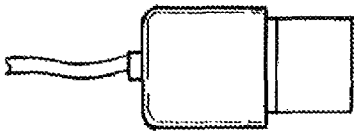

As with the first embodiment and as shown in FIG. 5B, the top surface 54' is folded back upon itself to create a single fold of the top surface overlying itself with the foam sandwich therebetween.

Figure 5D:
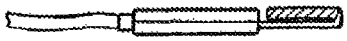

Thereafter, the single fold is then folded back over itself, again, such that the pickup has sections 56' and 56" overlying section 56 with the foam tape 58 disposed between sections 56" and 56, as shown in FIG. 5D.

As with the first embodiment, electrical tape 60 is used to wrap and envelope the piezoelectric sandwich.

It has been found that by doing this tri-fold, more of the piezo surface is picking up signal resulting in a fuller tone.

While basic pickup construction is well known and commercially available, the present pickup 50 is self-shielding and has enhanced noise reduction in either embodiment.

Since the present pickup 50 acquires the sound from both the bottom and the top of the wing slot, it, therefore, picks up the entire vibrational spectrum that is available at the wing slot.

By using the present pickup 50, the balance, fidelity and clarity of the generated sound is greatly enhanced.

It is readily appreciated that the present pickup 50 avoids the use of metal in the vibrational path, other than in the terminals and the coaxial cable. By eliminating metal, undesirable overtones caused by metal are eliminated.

Now and with reference to FIGS. 6-9 and in another aspect hereof, there is depicted a "cell" in accordance herewith, generally denoted at 150.

The cell 150 is a unit which, when emplaced on an electric violin, provides vibration at the bridge 102 similar to that from an acoustic instrument. This results in a timbre that is substantially the same as that from an amplified acoustic when used with a suitable pickup. The cell 150 uses the same principal and is a mechanical analog of a top of an acoustic violin, at least as far as the interplay on the top, the bass bar, the bridge and the sound post or sound bar.

As noted hereinabove, the cell 150, when used in combination with an electric instrument coupled with a pickup, simulates the sound of an acoustic violin by providing a mechanism to produce similar vibrational patterns in the bridge 102.

The pickup is preferably, the pickup of the present invention. However, it is to be understood that the cell 150 can be used with conventional pickups. But for optimum use the pickup hereof should be used in combination therewith.

The cell 150 comprises a table 152. The table 152 has an upper surface 154 and a bottom surface 156. The table 152 is a vibratory mass which is vibrated when the violin strings are played. A strip or dowel 158 is adhered to the bottom 156 of the table 152. The strip 158 is adhered by any suitable means, such as, with an epoxy glue or the like. The strip 158 is disposed parallel to the centerline of the violin 104 and is disposed under the bass foot 106 of the bridge 102 of the violin 104 and rests on the upper surface body 103 of the violin 104. The strip 158 defines a bass bar disposed proximate the rear of the bass foot.

A second dowel 164 is secured to the bottom surface 156 of the table 152 and extends downwardly therefrom. The dowel 164 may be secured to the table 152 by gluing or the like or may be left adjustable akin to acoustic violin practice.

In use, the dowel 164 is of the same height as that of the bass bar 158 and is disposed behind the treble foot 108 of the bridge 102. The dowel 164 defines a sound bar. It is adjusted in the same manner as a conventional sound post in a manner well-known to the skilled artisan.

A stabilizer 166 (FIG. 8), such as a wooden wedge 168 is used to keep the table 152 flat and substantially parallel to the upper surface 103 of the violin 104 by opposing the cantilever forces due to bridge/sound bar offset.

The stabilizer 166 is secured to the bottom 156 of the table 152 by gluing or the like.

Figure 8:
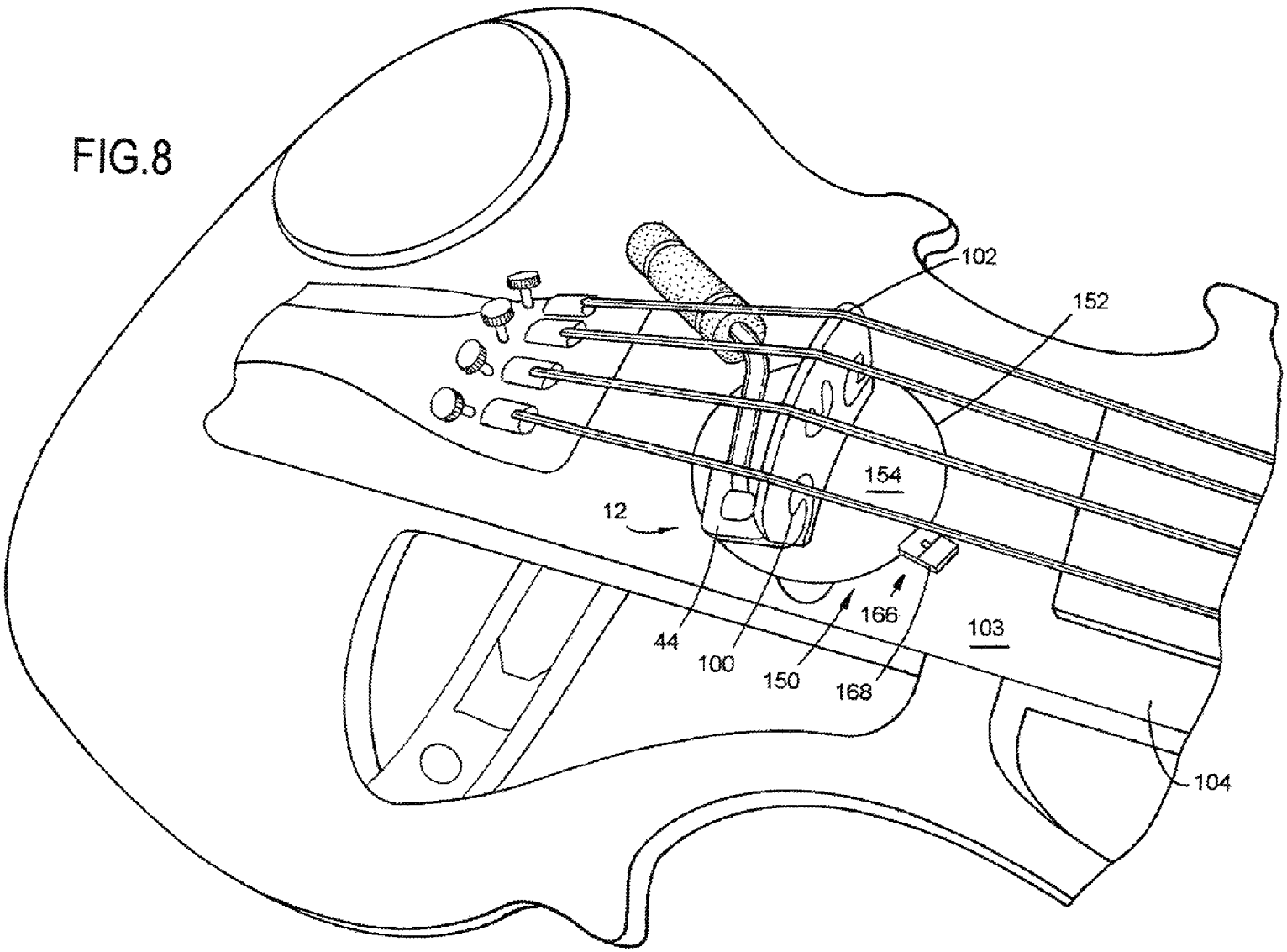
FIG. 8 is a top view of a solid body electric violin having the pickup and cell of FIG. 6 installed thereon.
Figure 9:
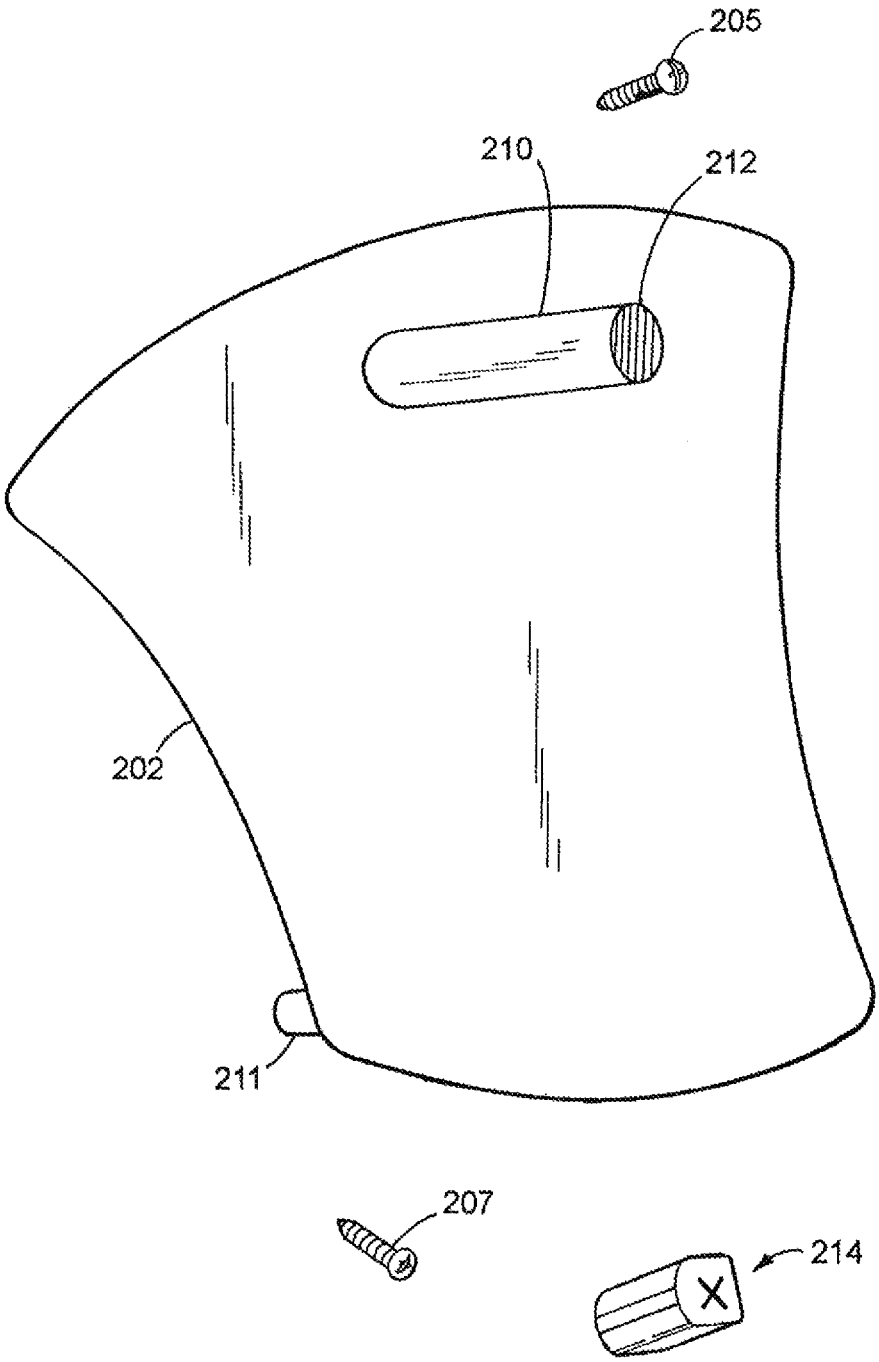
FIG. 9 is a bottom view of a second embodiment of the cell hereof with the sound bar removed.
Figure 11:
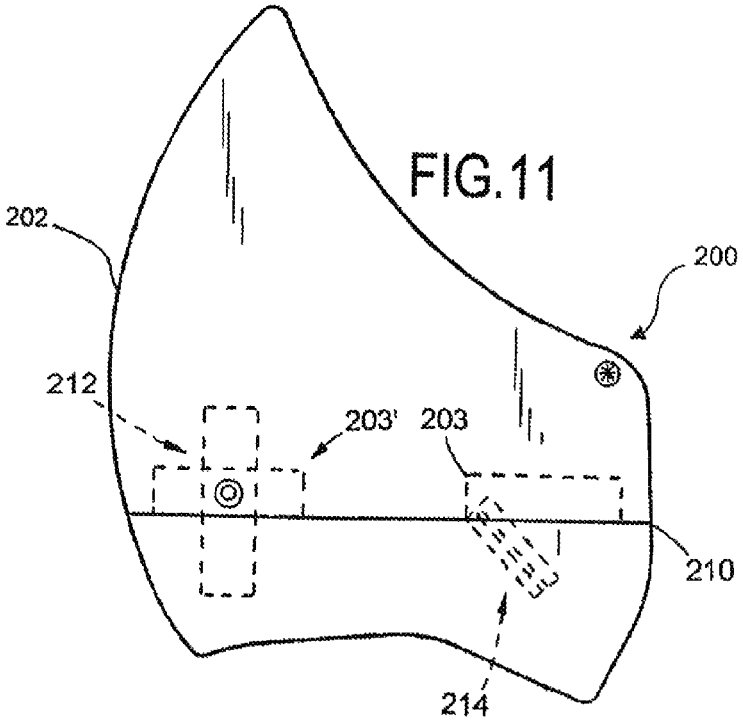
FIG. 11 is a top view, partly in phantom, of the second embodiment of the cell used herein.
Figure 12:
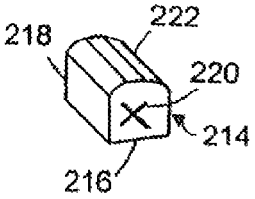
FIG. 12 is a perspective view of the sound bar used in the second embodiment of the present cell.
Figure 10:
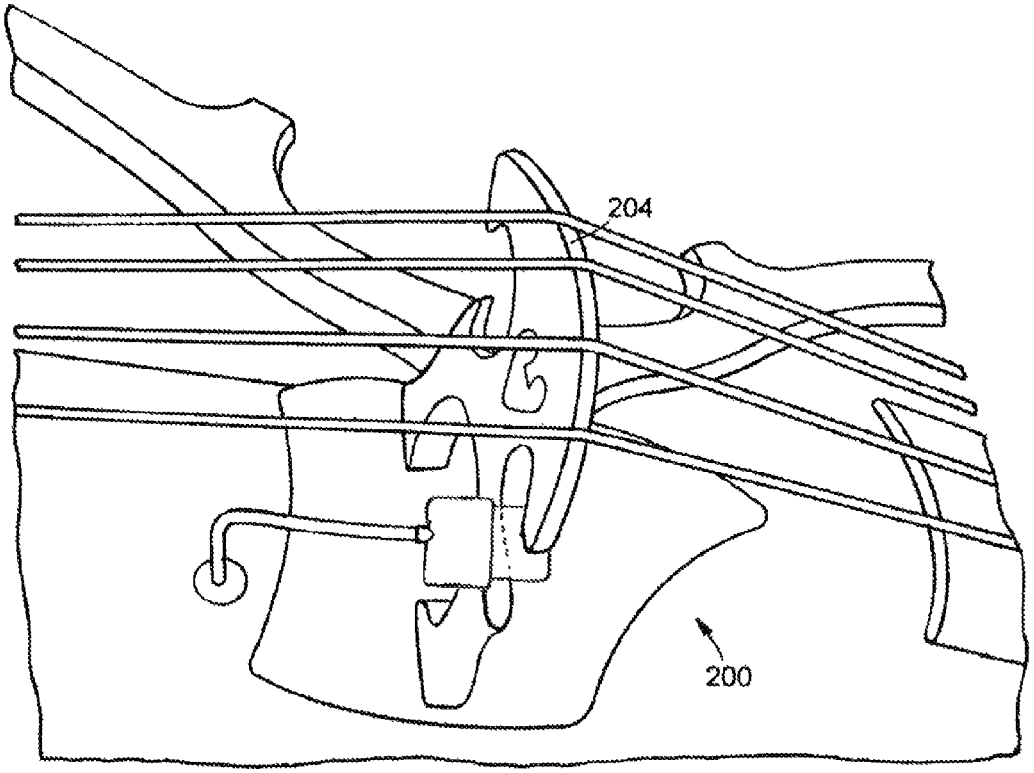
FIG. 10 is a top view of an instrument showing the installation of the second embodiment of the cell hereof.

As shown in FIG. 8, the table 152 is disposed above the upper surface 103 of the violin 104, substantially parallel thereto, and is positioned beneath the bridge 102.

In operation, the table 152 vibrates similarly to and uses the same basic principles of sound generation as an acoustic instrument. This results in vibrations from the table 152 being directed back into the bridge 102 as in an acoustic instrument In addition to acoustic sounds, the cell 150 is capable of making a wide range of different tones and timbres available by adjustment of the dowel 164 and the stabilizer 166.

Due to the thickness of the cell 150, necessarily it is deployed with a bridge having a "low profile" aspect for retrofitting to an existing instrument.

While the table 152 is optimally made of a soft wood, such as spruce, other materials, such as acrylic plastic, polycarbonate or the like can be used.

Similarly, the stabilizer 166 can be made from a plastic. Also, although shown in conjunction with a four string violin, the present cell 150 as well as the pickup 10 can be used with a five string or other multi-stringed violin.

Now, and with reference to the drawing, and in particular FIGS. 9-12, there is depicted a second embodiment of a cell, in accordance herewith and, generally, denoted at 200.

As with the first embodiment, the cell 200 comprises a table 202 which, herein, is of an irregular pattern similar to an ax blade.

The table 202 is disposed beneath and is in contact with the feet 203, 203' of the bridge 204.

As with the first embodiment, a dowel 212 is secured to the bottom surface of the table 202, extends downwardly therefrom, and defines a bass bar. The bass bar 212 is secured to the table 202 by either fastening it with a fastener, by gluing or the like. The bass bar 212 is disposed directly beneath the bass foot 203' of the bridge 102.

The table 202 is secured to the violin top 103 via a threaded fastener 205 or the like extending from the top of the table 202 through the bass bar 212 into the instrument body. A second dowel 211, defining a sound bar 214, is disposed beneath the table 202 and is likewise secured to the instrument body via a fastener 207.

As shown, the sound bar 214 comprises a solid member formed from any suitable material but, preferably, from wood, and includes a bottom wall 216, a pair of upstanding spaced-apart, parallel sidewalls 218 (only one of which is shown) and opposed upwardly extending end walls 220. The top wall 222 is a curvilinear wall which cooperates with the other walls to form an integrally formed unitary member. In accordance herewith, a "mailbox" fulcrum defines the sound bar 214.

The sound bar 214 is positionable at any desired point on the bottom surface of the table 202 and can be rotated about a horizontal axis or otherwise angled.

The sound bar or post 214 is disposed beneath the top of the instrument and the bottom surface of the table 202 and is frictionally retained in position by having a dimension slightly larger than the distance between the top of the instrument and the bottom of the table 202, which distance is maintained by the bass bar 212.

A line 210 is etched on or otherwise generated and provided on the top surface of the table 202. The line 210 defines the rear of the bridge feet 203, 203'.

It is to be appreciated from the preceding that there has been described herein an improved pickup which can be used alone or in conjunction with the cell on both electric and acoustic stringed instruments. The cell, itself, when used with a pickup enhances the sound of an electric stringed instrument to closely approximate an acoustic instrument.

Having, thus, described the invention, what is claimed is:

1. A cell for use with a stringed instrument of the type having a wing slot bridge, the cell comprising:

(a) a substantially planar table having a top surface and a bottom surface;

(b) a sound bar;

(c) a stabilizer for maintaining the table in a substantially planar manner;

(d) a bass bar; and wherein both the sound bar and the bass bar are extendable between the bottom surface of the table and a top surface of a stringed instrument, and further wherein the cell is mounted atop the top surface of the stringed instrument.

2. The cell of claim 1 wherein the sound bar comprises a solid member having:

(e) a bottom wall;

(f) a pair of opposed sidewalls extending upwardly from the bottom wall;

(g) a pair of opposed end walls extending upwardly from the bottom wall, the pair of opposed end walls interconnecting the opposed sidewalls;

(h) a curvilinear top wall; and wherein each of the walls cooperate to define an integrally formed unitary member.

3. The cell of claim 1 wherein the table is positionable between a wing slot bridge and the top surface of a stringed instrument.

4. The cell of claim 1 wherein the sound bar is securable to the bottom surface of the table.

5. The cell of claim 1 wherein the sound bar is positionable under a treble foot of a wing slot bridge of a stringed instrument.

6. The cell of claim 1 wherein the sound bar is frictionally retainable in position and having a dimension greater than the distance between the bottom surface of the table and a top surface of a stringed instrument.

7. The cell of claim 1 wherein the sound bar is positionable at any desired location along the bottom surface of the table.

8. The cell of claim 1 wherein the stabilizer is securable to the bottom surface of the table.

9. The cell of claim 1 wherein the bass bar is substantially the same height as the sound bar.

10. The cell of claim 1 wherein the bass bar is securable to the bottom surface of the table.

11. The cell of claim 1 wherein the bass bar is positionable under a bass foot of a wing slot bridge of a stringed instrument.

12. In combination: a cell and a piezoelectric pickup for use with a stringed instrument of the type having a wing slot bridge:

(a) the cell comprising:

(1) a table;

(2) a sound bar; comprising;

(i) a bottom wall;

(ii) a pair of opposed side walls extending upwardly from the bottom wall;

(iii) a pair of opposed end walls extending upwardly from the bottom wall, the pair of opposed end walls interconnecting the opposed sidewalls;

(iv) a curvilinear top wall; and wherein each of the walls cooperate to define an integrally formed unitary member;

(3) a stabilizer for maintaining the table in a substantially planar manner;

(4) a bass bar;

(b) the pickup being tri-folded and comprising means for urging the folded piezoelectric element into contact with both an upper and lower wall of wing slot bridge the folded piezoelectric element having a gap formed therein the means for urging being disposed in the gap; and the piezoelectric pickup further comprising:

(a) a first conducting film;

(b) a second conducting film; and (c) a piezoelectric material sandwiched between the first and second conducting films;

(d) a shield;

the first conducting film being connected to the shield and the second conducting film is connected to a center conductor; and both the sound bar and the bass bar are extendable between the bottom surface of the table and a top surface of a stringed instrument.

13. The combination of claim 12 wherein the table is positionable between a wing slot bridge and a top surface of a stringed instrument.

14. The combination of claim 12 wherein the sound bar is securable to the bottom surface of the table.

15. The combination of claim 12 wherein the bass bar is securable to the bottom surface of the table.

* * * * *